United States Patent [19]

Okada

[11] 4,141,307

[45] Feb. 27, 1979

[54] THREAD CUTTING MECHANISM FOR SEWING MACHINES

[75] Inventor: Ryohei Okada, Takahama, Japan

[73] Assignee: Aisin Seiki Kabushiki Kaisha, Kariya, Japan

[21] Appl. No.: 835,592

[22] Filed: Sep. 22, 1977

[30] Foreign Application Priority Data

Sep. 24, 1976 [JP] Japan ..... 51-114849

[51] Int. Cl.[2] ..... D05B 49/00

[52] U.S. Cl. ..... 112/292

[58] Field of Search ..... 112/291, 292, 295, 298

[56] References Cited

U.S. PATENT DOCUMENTS

| | | | |
|---|---|---|---|
| 3,211,117 | 10/1965 | Speichermann et al. | 112/292 |
| 3,424,116 | 1/1969 | Hagen | 112/298 |
| 3,503,355 | 3/1970 | Hagemeyer et al. | 112/292 |
| 3,624,735 | 11/1971 | Hedegaard | 112/292 |
| 3,776,161 | 12/1973 | Papajewski | 112/292 |
| 3,894,502 | 7/1975 | Hager et al. | 112/291 |

FOREIGN PATENT DOCUMENTS

| | | | |
|---|---|---|---|
| 1485424 | 10/1972 | Fed. Rep. of Germany | 112/298 |
| 192612 | 7/1967 | U.S.S.R. | 112/291 |

*Primary Examiner*—Ronald Feldbaum

*Attorney, Agent, or Firm*—Finnegan, Henderson, Farabow & Garrett

[57] ABSTRACT

A sewing machine having a shuttle device rotatable in a horizontal plane. A shuttle opener is swingably provided at one side of the shuttle device and a shuttle retainer is provided at the other side for restraining the shuttle device against rotation. A thread catcher arm of the thread cutting mechanism is provided for swinging movement in a horizontal plane between an advanced position and a retracted position. A rotary solenoid provides the swinging movement of the catcher arm into the advanced position and a cam mechanism is provided for effecting the return movement of the catcher arm during which the thread cutting is performed.

5 Claims, 18 Drawing Figures

THREAD CUTTING MECHANISM FOR SEWING MACHINES

The present invention relates to an automatic thread cutting mechanism for sewing machines and more particularly for a thread cutting mechanism for sewing machines having an automatic horizontal shuttle device.

In sewing machines having a shuttle device which is rotatable in a horizontal plane, there have hithertofore been difficulties in providing an automatic thread cutting mechanism in a limited space between the throat plate and the upper surface of the shuttle device. Generally, such automatic thread cutting mechanism includes a thread catcher arm which is adapted to be swung horizontally across the aforementioned space provided between the throat plate and the shuttle device for catching the upper and lower threads and drawing them to the cutting position. However, in conventional thread cutting mechanisms, it has been difficult to provide such thread catcher arms with an adequate rigidity as required for performing their functions. Since the space above the shuttle device must be utilized for locating a shuttle body opener and a shuttle body retainer which are essential for the function of the shuttle device, difficulties have often been encountered in finding a space available to the thread cutting mechanism. Further, due for the limitation of the available space, it has been quite difficult to have the thread catcher arm operated in optimum relationship with respect to the operation of the shuttle body opener. Thus, conventional thread cutting mechanisms have been dissatisfactory in respect to reliableness of operation.

The present invention has therefore an object to provide an automatic thread cutting mechanism for sewing machines which is reliable in operation and can be compactly arranged in a space available above the shuttle device.

Another object of the present invention is to provide an automatic thread cutting mechanism for sewing machines in which the operation of the shuttle body opener is so related with the operation of the thread catching device that a reliable operation of the device can be ensured.

A further object of the present invention is to provide a thread cutting mechanism for sewing machines in which the threads are caught under a tensioned condition.

According to the present invention, the above and other objects can be accomplished by a sewing machine comprising a shuttle device which includes a shuttle race provided on a vertically extending shuttle driving shaft, a shuttle body having an upper surface and housed in said shuttle race for providing a supply of lower thread, means for rotating said driving shaft, shuttle body retaining means provided at one side of the shuttle race for holding said shuttle body against rotation, and a shuttle body opener provided at a side of the shuttle race opposite to the retaining means and adapted to engage when actuated with said shuttle body for controlling resistance against drawing out of the lower thread therefrom; a needle mounted for vertical reciprocating movement and adapted to feed an upper thread into operative engagement with said shuttle device; a thread cutting mechanism including a thread catcher arm disposed at the side of the shuttle race opposite to the shuttle body opener and reciprocatingly movable along said upper surface of the shuttle body for catching the threads in return movement, movable cutting edge provided on said thread catcher arm, stationary cutting edge for co-operation with the movable cutting edge on said thread catcher arm in its return movement, means for actuating said thread catcher arm in synchronized relationship with the operation of the shuttle device.

In a preferable mode of the present invention, the thread catcher arm is secured to a second vertical shaft for swinging movement in response to the rotation of the second shaft, said second shaft being provided with a cam follower adapted to be brought into engagement with a cam which is rotated with said driving shaft, said cam having a profile for effecting said return movement of the catcher arm. More preferably, a rotary solenoid is provided on the second shaft for rotating it to a position where the cam follower is engageable with said cam and at the same time advancing said catcher arm.

The above and other objects and features of the present invention will become apparent from the following descriptions of a preferred embodiment taking reference to the accompanying drawings, in which.

Figure 1:
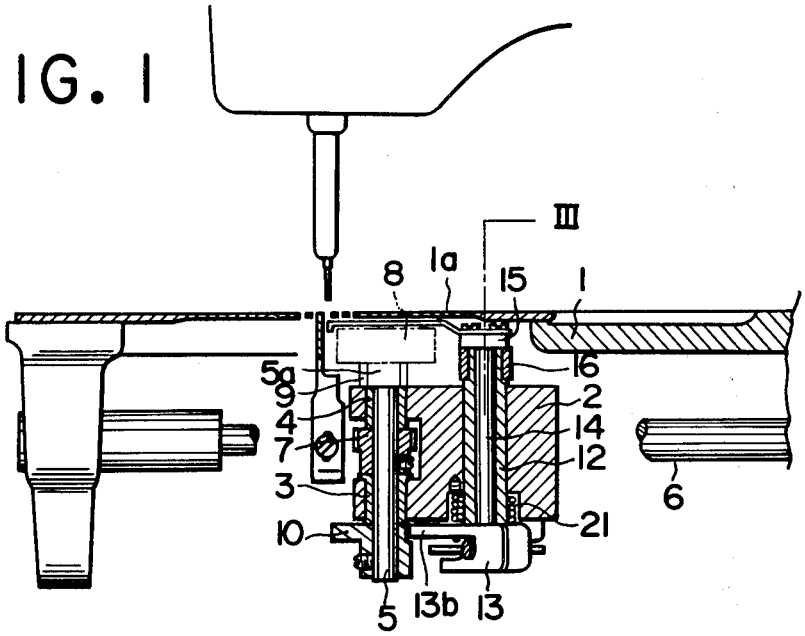
FIG. 1 is a fragmentary vertical sectional view of a sewing machine embodying the feature of the present invention.
Figure 2:
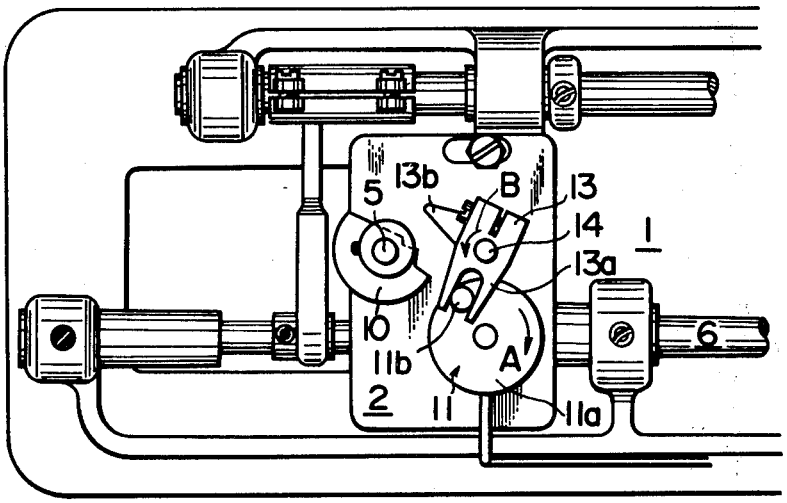
FIG. 2 is a fragmentary bottom view of the sewing machine shown in FIG. 1.
Figure 3:
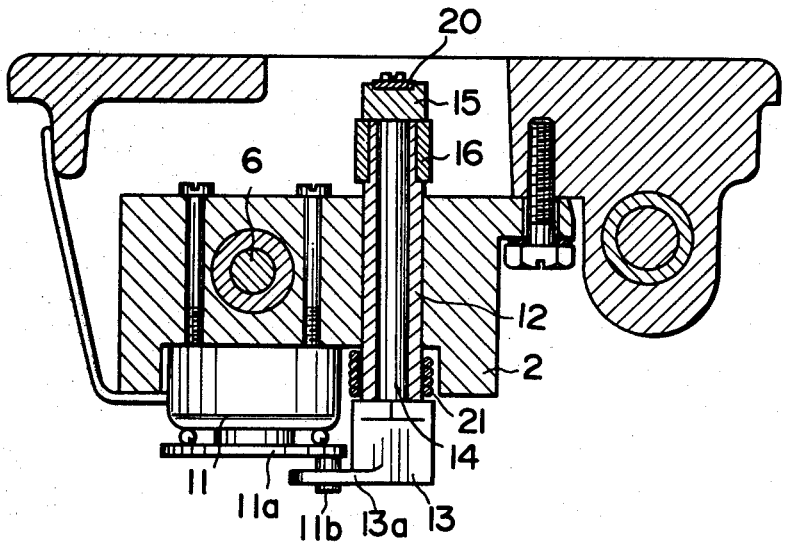
FIG. 3 is an enlarged sectional view taken substantially along the line III—III in FIG. 1.

Referring now to the drawings, particularly to FIGS. 1 through 3, the sewing machine shown therein includes a needle N and a machine bed 1 carrying a throat plate 1*a*. Beneath the machine bed 1, there is provided a shuttle support block 2 which is mounted on the machine bed 1. The shuttle support block 2 rotatably carries a vertically extending shuttle driving shaft 5 by means of a pair of vertically spaced sleeve bearings 3 and 4. Between the bearings 3 and 4, the driving shaft 5 is provided with a pinion 7 which is engaged with a gear (not shown) on a main drive axle 6 so that the driving shaft 5 is driven by the axle 6 at a speed two times as high as that of the axle 6.

Figure 6:
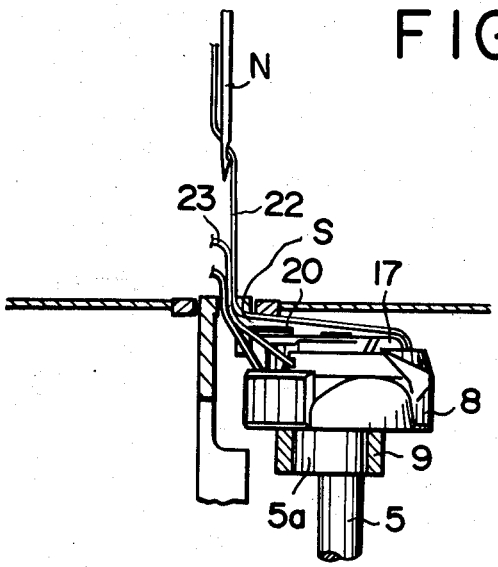
FIG. 6 is a fragmentary front view specifically showing the shuttle device.

The driving shaft 5 carries a shuttle race 8 at its upper end and is provided with an eccentric portion 5*a* beneath the shuttle race 8. The eccentric portion 5*a* on the driving shaft 5 is fitted with one end of an opener actuating lever 9 which is shown in FIGS. 4, 5 and 6.

Figure 4:
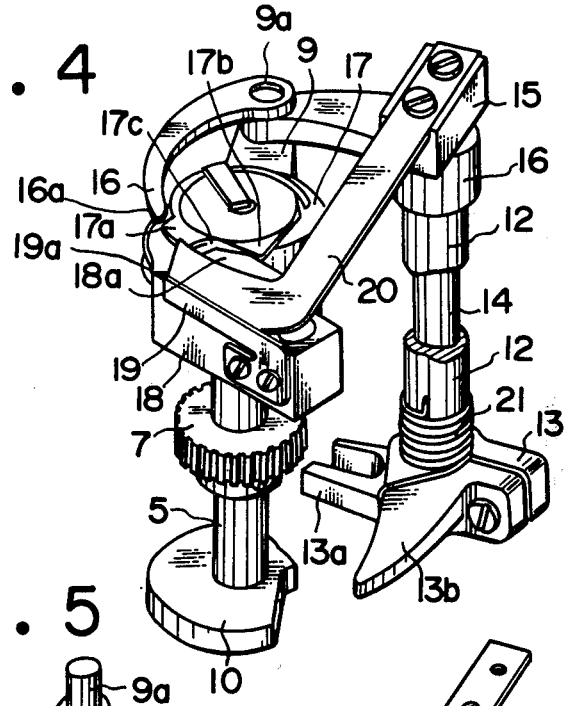
FIG. 4 is a perspective view of the thread cutting mechanism in inoperative position.
Figure 5:
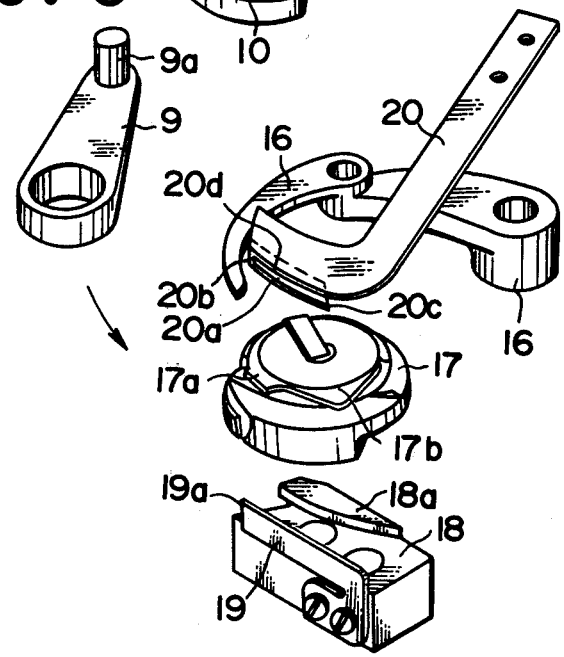
FIG. 5 is a breakdown perspective view of the thread cutting mechanism shown in FIG. 4.

As clearly shown in FIG. 4, the driving shaft 5 has a cam 10 which is secured to the lower end thereof. The shuttle support block 2 further carries a second vertical shaft 14 which is rotatably supported thereon through a sleeve bearing 12. At the lower end of the second rotatable shaft 14, there is provided a cam follower assembly 13 which comprises a bifurcated arm 13*a* and a cam follower arm 13*b*. As shown in FIGS. 2 and 3, the shuttle support block 2 carries a rotary solenoid 11 which is mounted on the lower surface of the block 2. The rotary solenoid has a disc 11*a* which is secured to the output shaft of the solenoid and has a pin 11*b* engaged with the bifurcated arm 13*a* of the cam follower assembly 13.

The rotary solenoid 11 is so designed that it is energized by electric power and rotated the output disc 11*a* by a predetermined angle in one direction as shown by an arrow A in FIG. 2. When the disc 11*a* of the rotary solenoid 11 is thus rotated, the cam follower assembly 13 and the shaft 14 and also rotated in the direction shown by an arrow B in FIG. 2. The cam follower assembly 13 is biased by means of a spring 21 in the opposite direction so that, under the de-energized position of the rotary solenoid 11, the cam follower arm 13*b* of the cam follower assembly 13 is located out of the trace of the cam 10. When the rotary solenoid 11 is energized, however, the cam follower assembly 13 is rotated as described above and the cam follower arm 13*b* is brought into the area wherein the arm 13*b* is engageable with the cam 10. The electromagnetic force of the solenoid 11 can be overridden by the force applied by the cam 10 to the cam follower arm 13*b* so that the cam assembly 13 and thus the second shaft 14 come under the control of the cam 10.

At the upper end of the sleeve bearing 12, there is swingably mounted a shuttle opener 16 at its one end. The shuttle opener 16 is engaged at its intermediate portion with a pin 9*a* provided on the free end of the opener actuating lever 9.

The shuttle race 8 on the driving shaft 5 receives a shuttle body 17 having a top plate which is formed with two projections 17*a* and 17*b* separated by a recess 17*c* formed therebetween. The opener 16 has a tip end 16*a* which is adapted to co-operate with the projection 17*a* on the top plate of the shuttle body 17. As previously described, the actuating lever 9 is mounted on the eccentric portion 5*a* on the shuttle driving shaft 5, so that the lever 9 is cyclically reciprocated in axial direction to move the tip end 16*a* of the shuttle opener 16 into and out of engagement with the projection 17*a* on the top plate of the shuttle body 17. As well known in the art, the lower thread drawn out of the bobbin is slackened when the shuttle opener 16 is out of engagement with the projection 17*a* of the shuttle body 17 but tensioned when the shuttle opener 16 is in engagement with the projection 17*a*.

At the side of the shuttle race 8 opposite to the shuttle opener 16, there is mounted on the shuttle support block 2*a* shuttle retainer 18 which has a retaining finger 18*a* adapted engage the recessed portion 17*c* on the top plate of the shuttle body 17 for holding the shuttle body 17 against rotation. The shuttle retainer 18 is further provided with a cutter blade 19 which has a cutting edge 19*a* on one end. As shown in FIG. 4, the cutter blade 19 is located to lie substantially in a vertical plane and the cutting edge 19*a* is located opposite the tip end 16*a* of the shuttle opener 16.

The second shaft 14 has a thread catcher arm 20 which is secured at one end to the upper end of the shaft 14. The arm 20 is in the form of an L-shaped plate and adapted to be swung across the top surface of the shuttle body 17. At the free end, the thread catcher arm 20 is folded back to define a thread catching groove 20*a* and a cutting edge 20*b*. The folded portion of the catcher arm 20 has a tip end 20*c*. The catcher arm 20 is provided with a side edge 20*d* which is adapted to be slidably engaged with an adjacent side surface of the cutting blade 19 so that the cutting edge 20*b* on the thread catcher arm 20 is brought into an operative co-operation with the cutting edge 19*a* on the cutting blade 19. The cutting blade 19 has an elasticity so that it can be deflected as desired when it is slidably engaged with the side edge 20*d* of the thread catcher arm 20. With the rotary solenoid 11 in de-energized position, the catcher arm 20 is retracted from the shuttle device. When the rotary solenoid 11 is energized, the catcher arm 20 is advanced across the upper surface of the shuttle body 17. At the same time, the cam follower arm 13*b* on the cam follower assembly 13 is brought into the position were it is actuated under the influence of the cam 10.

Although not shown in the drawings, the sewing machine may be provided with an automatic stopping means by which the sewing machine is stopped at a predetermined position such as the bottom dead center of the needle N before starting the operation of the thread cutting mechanism. Further, the sewing machine may be provided with electric switch means for initiating the operation of the thread cutting mechanism.

In operation of the thread cutting mechanism as described above, the sewing machine is at first stopped for example at the bottom dead center of the needle N and the starting switch is actuated. Then, the main axle 6 rotates and the needle N starts to move up. FIG. 6 shows the position of the needle N with the main axle 6 rotated by about 150° from the bottom dead center of the needle N. The upper thread is shown by the reference numeral 22 while the lower thread is represented by numeral 23.

Figure 7:
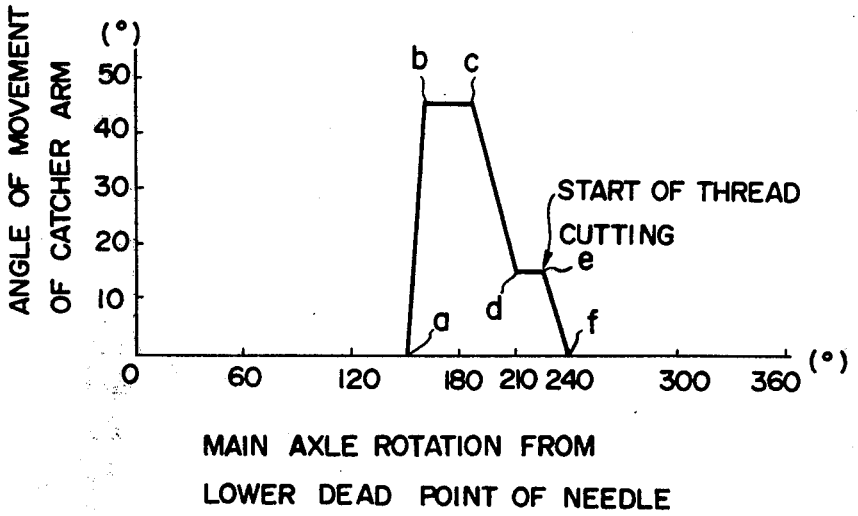
FIG. 7 is a diagram showing the relationship between the operation of the thread catcher arm and the angle of rotation of the main drive axle.
Figure 8:
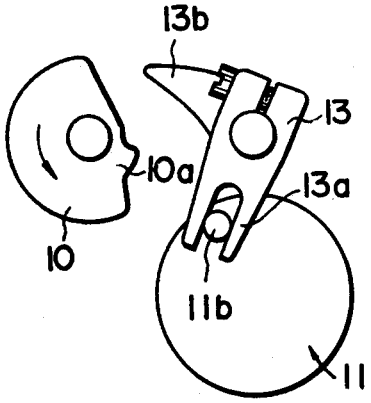
FIG. 8 is a diagrammatical bottom view of the cam and the cam follower in inoperative position.
Figure 9:
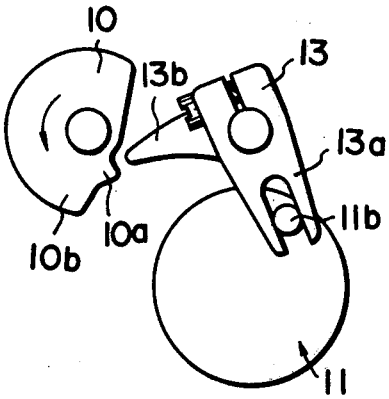
FIG. 9 is a view similar to FIG. 8 but showing the cam follower in a position engageable with the cam.

At this time of operation, the rotary solenoid 11 is energized through a suitable control means with the result that the shaft 14 is rotated through the bifurcated arm 13*a* of the cam follower assembly 13 to cause the swinging movement of the thread catcher arm 20. Thus, the arm 20 is advanced above the shuttle body 17. At the same time, the cam follower arm 13*b* is moved from the position shown in FIG. 8 to the position shown in FIG. 9. The above movement of the thread catcher arm 20 is shown by a line a–b in FIG. 7.

Figure 12:
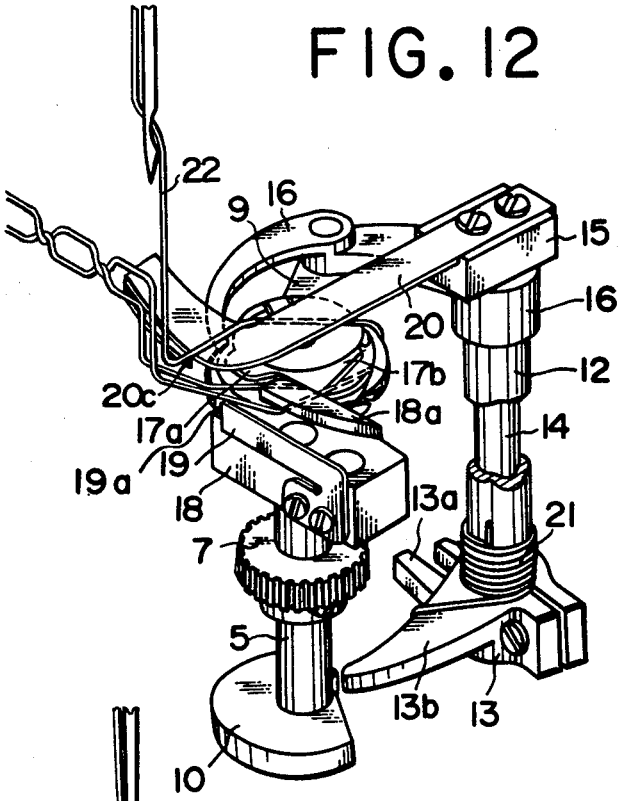
FIG. 12 is a perspective view showing the thread cutting mechanism with the catcher arm in the advanced position.

In this course of operation, the free end portion of the catcher arm 20 is advanced into a rectangular space S defined between the upper and lower threads 22 and 23 to the position as shown in FIG. 12.

Figure 10:
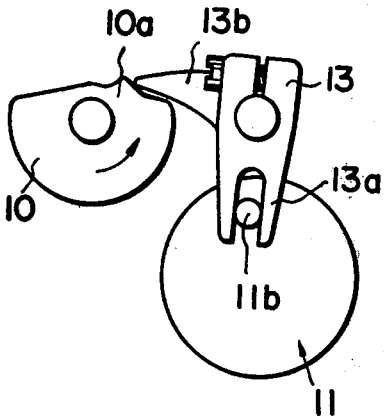
FIG. 10 is a view similar to FIGS. 8 and 9 but showing the first stage of the return stroke of the catcher arm.

As the driving shaft 5 is rotated, the lower profile 10*a* comes into engagement with the cam follower 13*b*. This position is shown at C in FIG. 7. As soon as the cam follower 13*b* rides on the lower profile 10*a* of the cam 10, the shaft 14 is rotated in the opposite direction against the influence of the rotary solenoid 11 as shown in FIG. 10. Thus, the thread catcher arm 20 is retracted through the position shown in FIG. 13 to the position shown in FIG. 14. This movement of the thread catcher arm 20 is shown by c–d in FIG. 7.

Figure 13:
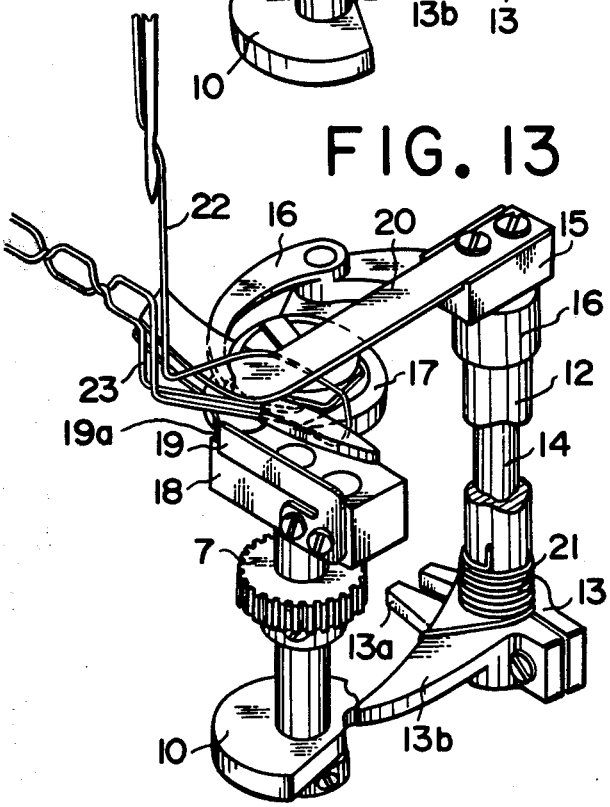
FIG. 13 is a perspective view showing the thread cutting mechanism in the first stage of the return stroke of the catcher arm.
Figure 14:
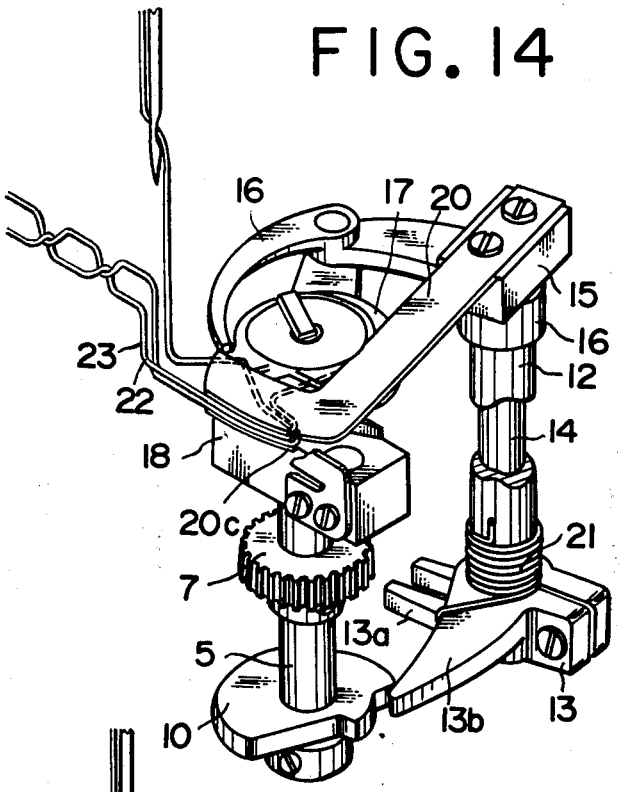
FIG. 14 is a perspective view of the thread cutting mechanism similar to FIGS. 12 and 13 but showing the thread catcher arm in cutting position.

In this period of operation, the rotation of the shuttle race 8 causes the upper thread 22 to pass under the shuttle body 17 as shown in FIGS. 13 and 14 so that the upper thread 22 as well as the lower thread 23 are caught by the thread catching groove 20*a*. A further rotation of the driving shaft 5 and thus the shuttle race 8 causes the upper thread 22 to advance further toward the cutting edge 20*b*. This course of operation is shown by d–e in FIG. 7.

Figure 11:
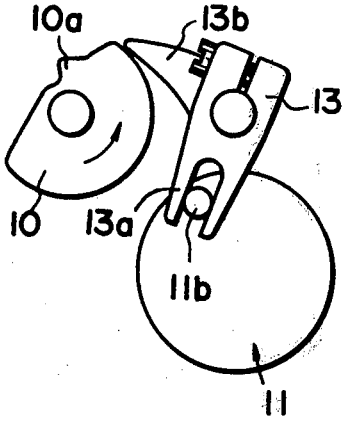
FIG. 11 is a view similar to FIGS. 8 through 10 but showing a position just after the completion of the return stroke of the catcher arm.
Figure 15:
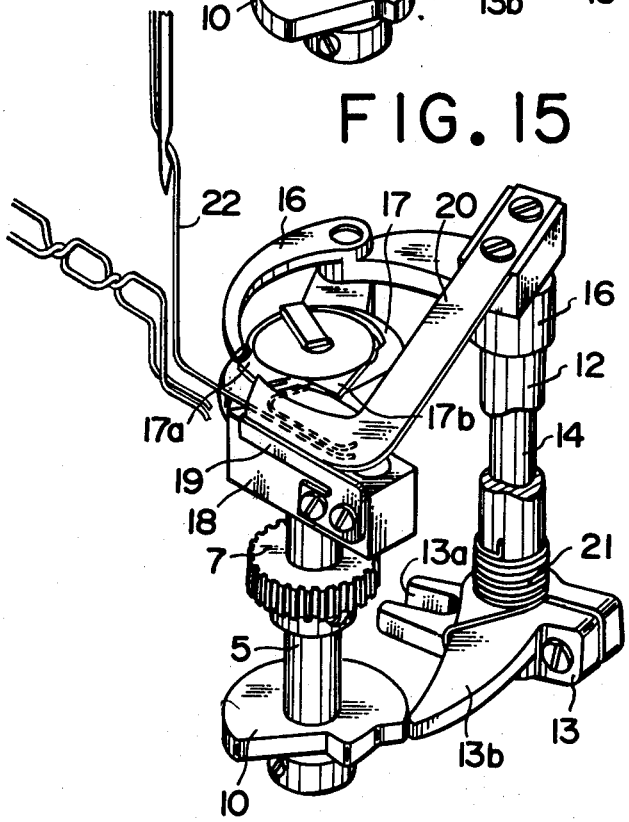
FIG. 15 is a perspective view of the thread cutting mechanism similar to FIGS. 12 through 14 but showing the catcher arm after completion of the return stroke.

Then, the driving shaft 5 is further rotated and the cam follower arm 13*b* rides on the upper profile 10*b* us shown in FIG. 11. Thus, the shaft 14 is further rotated and the catcher arm 20 is further retracted as shown by e–f in FIG. 7. The upper and lower threads 22 and 23 are thus cut by the co-operating cutting edges 19*a* and 20*b* and the leading ends of the threads 22 and 23 are held between the catcher arm 20 and the shuttle retainer 18 as shown in FIG. 15.

Figure 16:
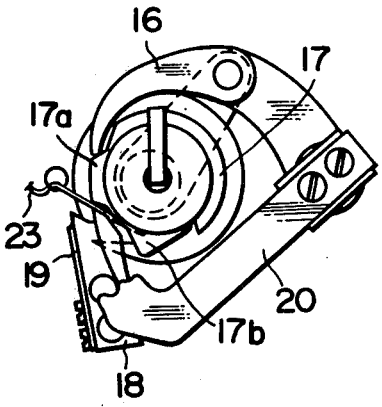
FIG. 16 is a top plan view of the thread cutting mechanism in the inoperative position.
Figure 17:
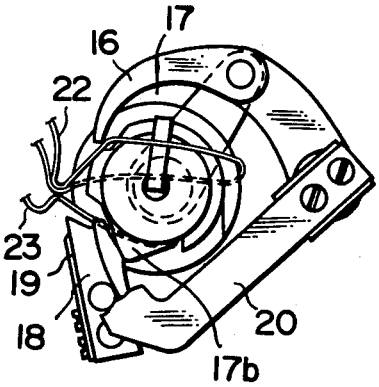
FIG. 17 is a view similar to FIG. 16 but showing the catcher arm in the advancing stroke.
Figure 18:
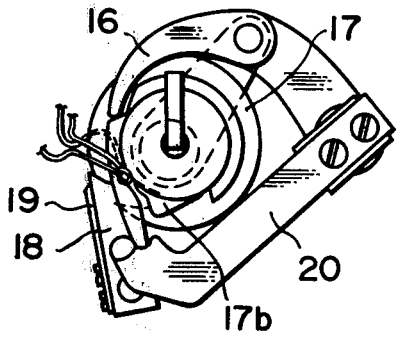
FIG. 18 is a view similar to FIGS. 16 and 17 but showing the catcher arm in the returning stroke.

In the above operation, the shuttle opener 16 is also actuated in synchronized relationship with the operation of the thread cutting mechanism. Referring to FIG. 16, the tip end 16*a* of the thread opener 16 is in engagement with the projection 17*a* on the top plate of the shuttle body 17. As the driving shaft 5 rotates to the position corresponding to the main axle position of 140° after bottom dead center, the shuttle opener 16 is moved apart from the projection 17*a* as shown in FIG. 17. Thus, the lower thread 23 is slackened as previously described. With the shuttle opener 16 in this position, the rotary solenoid 11 is energized to cause the swinging movement of the thread catcher arm 20. Therefore, the free end of the catcher arm 20 can be inserted without fail into the space S between the upper and lower threads 22 and 23.

Thereafter, at the main axle position of 170° after bottom dead center, the tip end 16*a* of the shuttle opener 16 is again brought into engagement with the projection 17*a* on the top plate of the shuttle body 17. Thus, the lower thread 23 is tensioned again. The cam follower arm 13*b* is then brought into engagement with the lower profile 10*a* of the cam 10 to retract the catcher arm 20. Since the lower thread 23 is tensioned at this time of operation, the catcher arm 20 catches the threads 22 and 23 without fail. Thus, the arrangement ensures a reliable operation of the thread cutting mechanism.

The arrangement is further advantageous in that the shuttle body retainer is positioned in the side of the shuttle body opposite to the shuttle opener and serves as a support for the cutting blade, so that the components for the thread cutting mechanism can be incorporated in a limited space. Further, the rotary solenoid and the cam provide a reliable function of the thread catcher arm.

The invention has thus been shown and described with reference to a preferable embodiment, however, it should be noted that the invention is in no way limited to the details of the illustrated arrangement but changes and modifications may be made wihtout departing from the scope of the appended claims.

What is claimed is:

1. A sewing machine having a vertically extending shuttle driving shaft and means for rotating the shaft, the sewing machine comprising:

a shuttle device including a shuttle race provided on the shuttle driving shaft, a shuttle body having an upper surface and housed in said shuttle race for providing a supply of lower thread, shuttle body retaining means provided at one side of said shuttle race for holding said shuttle body against rotation, and a shuttle body opener provided at a side of said shuttle race opposite to said retaining means and adapted to engage, when actuated, with said shuttle body for controlling resistance against the drawing out of the lower thread therefrom;

a needle mounted for vertical reciprocating movement and adapted to feed an upper thread into operative engagement with said shuttle device; and a thread cutting mechanism including:

a second vertically extending shaft;

a thread catcher arm disposed at the side of said shuttle race opposite to said shuttle body opener and secured at one end of said second shaft for swinging movement between an advanced position in which said catcher arm is extended over the upper surface of said shuttle body and a retracted position in which said catcher arm is retracted from the upper surface of said shuttle body for catching the threads in return movement;

a moveable cutting edge provided on said thread catcher arm;

a stationary cutter edge for cooperation with said moveable cutting edge to cut thread when said catcher arm returns from said advanced position to said retracted position;

a cam fixedly connected to said driving shaft;

a cam follower fixedly connected to said second shaft;

electromagnetic means for rotating said second shaft in a direction opposite to said shuttle driving shaft for bringing said catcher arm into said advanced position and at the same time bringing said cam follower into an operative position wherein it can be engaged with said cam which is rotated with said driving shaft;

said cam having a profile which, upon rotation of said shuttle driving shaft, engages said cam follower to effect return movement of said catcher arm from said advanced position to said retracted position; and means for actuating said shuttle body opener to restrain the drawing out of the lower thread from said shuttle body when said catcher arm returns from said advanced position to said retracted position.

2. The sewing machine in accordance with claim 1 wherein said stationary cutting edge is mounted on said shuttle body retaining means.

3. The sewing machine in accordance with claim 1 wherein said thread catcher arm is in the form of an L-shaped plate having a pivoted end and a free end, said catcher arm being formed at the free end with a folded back portion for providing a catching groove, said cutting edge being formed at the folded corner portion.

4. The sewing machine in accordance with claim 1 wherein said electromagnetic means is a rotary solenoid having means to bias said second shaft in the direction in which said catcher arm is advanced.

5. The sewing machine in accordance with claim 1 wherein said thread catcher arm is in the form of an L-shaped plate having a pivoted end and a free end, a folded back portion at the free end for providing a catching groove and a side edge provided along said folded back portion, said stationary cutting edge being provided on a cutting blade mounted on said shuttle body retaining means to extend in a vertical plane, said side edge on the catcher arm being adapted to engage slidably with said cutting blade.

* * * * *

UNITED STATES PATENT AND TRADEMARK OFFICE

CERTIFICATE OF CORRECTION

PATENT NO. : 4,141,307

DATED : Feb. 27, 1979

INVENTOR(S) : Ryohei Okada

It is certified that error appears in the above-identified patent and that said Letters Patent are hereby corrected as shown below:

Column 6, Claim 1, line 27, change "of" to --to--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*